US006563399B2

(12) United States Patent
Love

(10) Patent No.: US 6,563,399 B2
(45) Date of Patent: May 13, 2003

(54) ADJUSTABLE AZIMUTH AND PHASE SHIFT ANTENNA

(76) Inventor: Leo Love, 5814 Meaders La., Dallas, TX (US) 75230-5053

( * ) Notice: Subject to any disclaimer, the term of this patent is extended or adjusted under 35 U.S.C. 154(b) by 0 days.

(21) Appl. No.: 09/805,690

(22) Filed: Mar. 13, 2001

(65) Prior Publication Data

US 2001/0048351 A1 Dec. 6, 2001

Related U.S. Application Data

(63) Continuation-in-part of application No. 09/586,725, filed on Jun. 5, 2000.

(51) Int. Cl.[7] ..... H01P 1/18; H01Q 19/00

(52) U.S. Cl. ..... 333/156; 333/160; 343/778; 343/872

(58) Field of Search ..... 333/156, 160; 343/778, 872, 766

(56) References Cited

U.S. PATENT DOCUMENTS 4,616,195 A 10/1986 Ward et al. ..... 333/160
5,619,215 A * 4/1997 Sydor ..... 343/766
5,801,600 A 9/1998 Butland et al. ..... 333/127
5,818,385 A 10/1998 Bartholomew ..... 342/372
6,037,912 A * 3/2000 DeMarre ..... 343/815
6,097,267 A 8/2000 Hampel ..... 333/128
6,198,458 B1 3/2001 Heinz et al. ..... 343/853
6,246,381 B1 * 6/2001 Vandendolder et al. ..... 343/912
6,346,924 B1 2/2002 Heinz et al. ..... 343/853

* cited by examiner

*Primary Examiner*—Robert Pascal
*Assistant Examiner*—Joseph Chang
(74) *Attorney, Agent, or Firm*—Chalker Flores, LLP; Daniel J. Chalker

(57) ABSTRACT

A left and right hemisphere independently adjustable azimuth antenna with a new method of electrically floating reflector device when used with the cooperating antenna array geometry, yields an modified directed radiated beam which can be actuated by means of a simple mechanical mechanism. The adjustment in the azimuth pattern is accomplished by means of moving the electrically floating reflector device in an arc around a line parallel to the axis of the antenna.

20 Claims, 4 Drawing Sheets

ADJUSTABLE AZIMUTH AND PHASE SHIFT ANTENNA

RELATED APPLICATIONS

This application is a continuation-in-part of patent application Ser. No. 09/586,725 filed on Jun. 5, 2000.

TECHNICAL FIELD OF THE INVENTION

The present invention relates to the field of antennas. More particularly, the present invention relates to the method of shaping the azimuth patterns of the radiated beam from the antenna array both for broadcast and receive antennae.

BACKGROUND OF THE INVENTION

Several approaches may be used to shape the azimuth pattern of the radiation pattern from an antenna. One involves the use of hinged metal reflectors that are grounded to antenna and fastened with heavy bolts. This method is employed outside of the environmental cover of the antenna or radome. Since this method is constantly being exposed to the weather and wind, it must be strong enough to support wind loads. In addition the hinged metal reflectors, being electrically grounded to the antenna, must be securely fastened after adjustment. Also it is important to note that during adjustment the antenna array is unsuited for service due to the intermodulation distortion and electrical noise created during hinged metal reflector adjustment. This noise and signal distortion is due to the intermittent ground path through the metal to metal contact of the hinged attachment of the reflector to the array of the antenna. Another approach uses replaceable reflector brackets which mount to the outside structure of the antenna, that is outside of the radome of the antenna. During replacement of the reflector brackets the subject antenna is unsuitable for service due to the intermodulation distortion and electrical noise created. The replaceable reflector brackets are limited to incremental azimuth angle adjustments and do not offer continuous variability as is available with the hinged metal reflectors.

Producing a incremental azimuth pattern adjustment, however, is too rigid an approach for many applications. An incremental azimuth pattern adjustment solution cannot be altered to fit changing circumstances, and does not allow for optimizing the carrier-to-interference ratio and requires physical presence to make the change. Of the continuously variable azimuth pattern adjustment methods, the hinged metal bracket method produces inter-modulation products, and requires physical presence to make the change. Therefore, existing methods of providing azimuth pattern adjustment, for example using hinged metal reflectors, and replaceable reflector brackets are labor intensive, and so are often unreliable and expensive for the purpose of optimization of the azimuth pattern for the improved performance of the wireless network.

The complexity of the previously described methods stem from the need to be physically present to affect the desired change in the azimuth pattern of the antenna as well as the need to discontinue service of the subject antenna during modification. It is generally known in the art that a receive antenna responds, and is directly related, to a radiation pattern broadcast by the antenna. Thus, the methods associated with azimuth pattern adjustment to a broadcast antenna are applicable to adjusting a receive antenna to improve its reception in a particular direction.

As a result and in light of an ever more competitive environment, it is desirable to manufacture an antenna with the ability to adjust the orientation of the radiated beam. Due to continued cost constraints it is desirable to produce antenna of the most simple design and greatest ease of manufacture.

SUMMARY OF THE INVENTION

By the reshaping of the azimuth patterns of the radiated beam the antenna structure of the present invention can remain in operation and new antenna pattern requirements can be fulfilled using the original antenna and thus save the time and expense of replacing the original antenna with another antenna of a different azimuth pattern now needed in the wireless network. An adaptable antenna is desirable as it is simpler to adjust the antenna by actuators for the reorientation of the radiated beam. An adaptable antenna also lends itself to the remote operation of the actuators so as to remove the need to be physically present for the reorientation of the antenna radiated beam.

The present invention is an antenna array which includes a number of antenna elements, being dipoles or other radiating elements being vertically polarized or plus and/or minus 45 degree, or horizontally polarized to the axis of the antenna and electrically floating beam shaping reflectors that by means of precise geometry and movement inside the radome adjust the left and right hemisphere independent azimuth radiation pattern of the radiated beam. The present invention overcomes many of the shortcomings of prior art. Instead of using hinged metal reflectors which are electrically grounded, the present invention employs a light weight electrically floating reflector that is position inside the protective cover of the antenna radome thus allowing the precise continuous adjustment of the azimuth pattern of the antenna by a means of remotely controlled actuators. Being an electrically floating reflector, allows for adjustment to be made during the time the antenna is in service thus eliminating the need to take the antenna out of service to affect the adjustment. Positioning the electrically floating reflector inside the antenna radome also protects the mechanism from the weather greatly reducing contamination of the mechanism. The elimination of metal to metal contact of the electrically floating reflector also greatly reduces the introduction of intermodulation distortion and the generation of electrical noise. Though prior art is referenced, the present invention achieves similar but improved results, is an entirely different method than those that use hinged metal reflectors and replaceable brackets.

An antenna array which includes an antenna array which includes a number of antenna elements, being dipoles or other radiating elements being vertically polarized or plus and/or minus 45 degree, or horizontally polarized to the axis of the antenna and electrically floating beam shaping reflectors according to the present invention is capable of continuously varying the left and right azimuth independent, azimuth of the radiated beam of the radiation pattern associated with an antenna, the radiation pattern comprising an RF signal, the antenna having a plurality of elements and having an element terminal for each element and further having a feed system for communicating the RF signal between each element terminal and a common feed terminal. An antenna beam shaping device according to the present invention includes two electrically floating beam shaping reflectors that by means of precise geometry and movement inside the radome adjust the azimuth radiation pattern, left and right independent, of the radiated beam. It is this electrically equivalent adjustable horizontal aperture by means of the electrically floating beam shaping reflector device which allows the adjustment of the length of the effective horizontal dimension of the antenna which causes for the change in the azimuth radiated pattern of the radiated beam of the antenna.

The electrically floating reflectors due to their shape and relative positions cause the azimuth radiated pattern of the radiated beam to be adjusted in both left and right hemisphere of the radiated beam either in unison or independently in any relationship within the range of azimuth adjustment.

BRIEF DESCRIPTION OF DRAWINGS

The above features and advantages of the invention will become apparent from consideration of the subsequent detailed description presented in connection with accompanying drawings and sections thereof, in which.

DETAILED DESCRIPTION OF THE INVENTION

A left and right hemisphere independently adjustable azimuth antenna with a new method of electrically floating reflector device when used with the cooperating antenna array geometry, yields a modified directed radiated beam which can be actuated by means of a simple mechanical mechanism. The adjustment in the azimuth pattern is accomplished by means of moving the electrically floating reflector device in an arc around a line parallel to the axis of the antenna.

Figure 1:
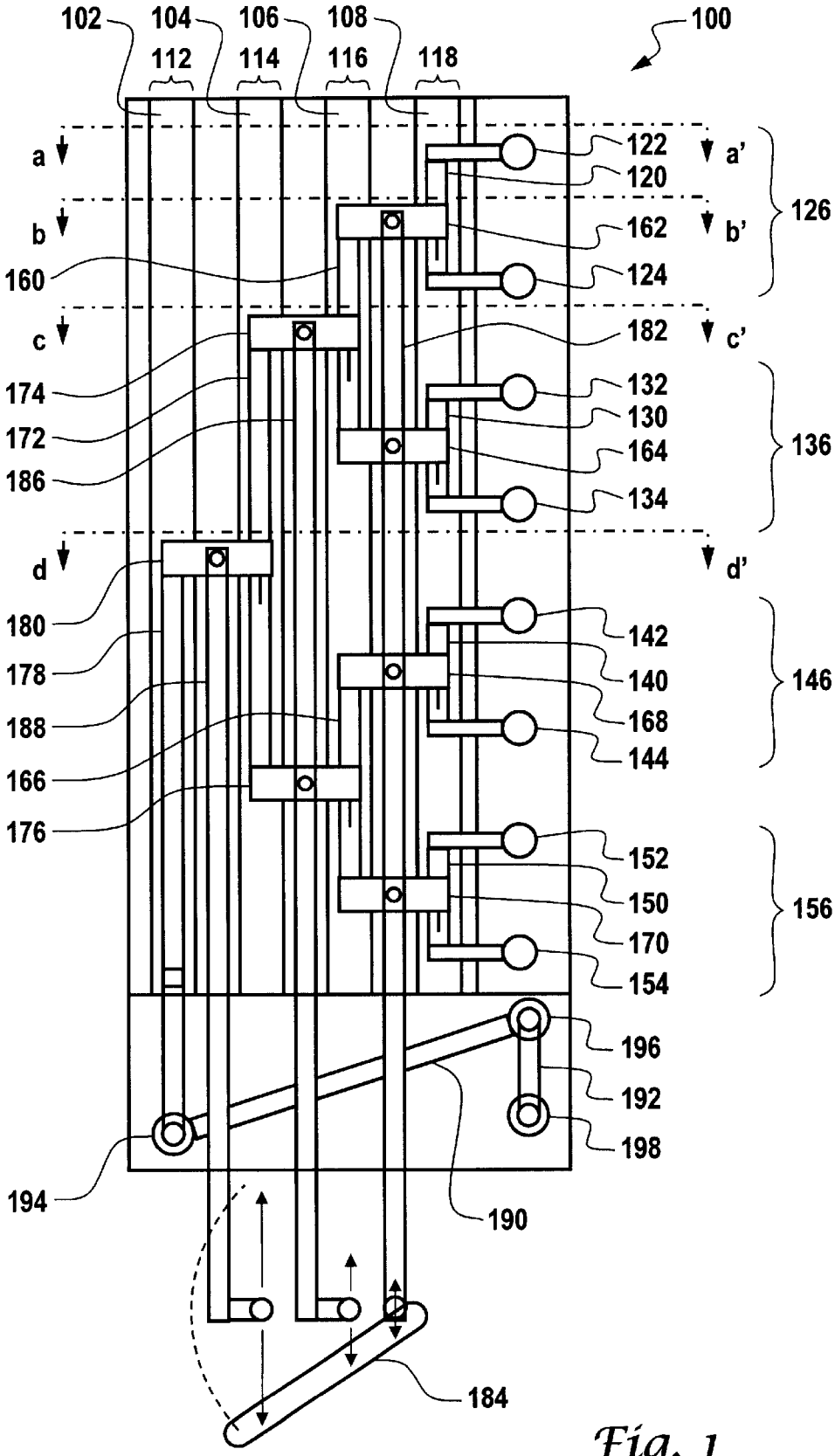
FIG. 1 depicts an adjustable phase shift mechanism for an eight element antenna in accordance with the present invention.

Referring now to FIG. 1, an adjustable phase shift mechanism 100 for an eight element antenna is shown in accordance with the present invention. The body of the phase shift mechanism 100 is composed of an extruded or otherwise formed shape, such as aluminum, so that parallel cavities 102, 104, 106 and 108 are formed to make up the outer conductor of an air line coaxial feed system. See also FIG. 2A. Each of these cavities 102, 104, 106 and 108 have openings 112, 114, 116 and 118 respectively that are approximately equal to the diameter of the center conductor when placed in the center of the opening would form a transmission line of 50 ohm impedance. See also FIG. 2A. Each of these openings 112, 114, 116 and 118 face upwards away from the back reflector 202 (FIG. 2A) of the antenna array. In a corporate feed system, each of the adjacent lines form the lines necessary to feed each of the radiating elements 310 (FIG. 3) equally as determined from the input connection. The radiating elements 310 (FIG. 3) are connected to terminal elements 120, 122, 124, 126, 128, 130, 132 and 134.

The cavity or outer conductor adjacent to the radiating elements 310 (FIG. 3) will join four groups of two elements each by the connection of the element center conductors of each element to the center conductor running inside the cavity between the four groups of two elements. Continuing the next phase shifter will couple energy from the center of the four groups of two to form two groups of four and so on to the next line to join the upper four elements to the lower four elements. The described center conductor lines and their accompanying phase shifters all move in unison in such a relationship to create a linear phase taper across all is radiating elements in the array. The movement of these lines can be accomplished in one of several ways one of which may be by a lever placed in perpendicular relationship to the parallel feed lines and attached to mechanical arms that attach themselves to each group of phase shifters.

Cavity 108 or outer conductor adjacent to the radiating elements 310 (FIG. 3) contains four feed lines 120, 130, 140 and 150. Feed line 120 connects terminal elements 122 and 124 to form element group 126. Similarly, feed line 130 connects terminal elements 132 and 134 to form element group 136, feed line 140 connects terminal elements 142 and 144 to form element group 146, and feed line 150 connects terminal elements 152 and 154 to form element group 156.

Figure 2A:
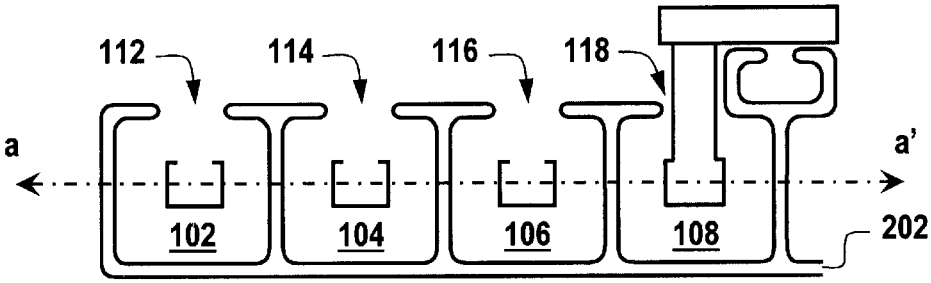
FIGS. 2A, 2B, 2C and 2D are cross-sectional views along the lines as shown in FIG. 1 of the phase shift mechanism in various positions in accordance with the present invention.
Figure 2B:
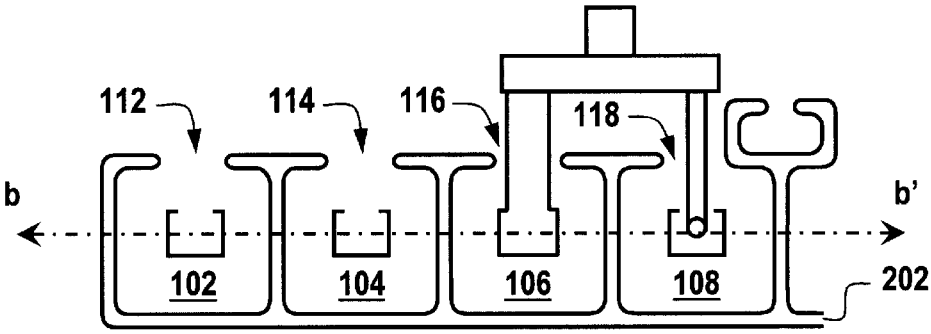

Cavity 106 contains two feed lines 160 and 166. One end of feed line 160 is connected to feed line 120 via phase shifter 162. The other end of feed line 160 is connected to feed line 130 via phase shifter 164. Similarly, one end of feed line 166 is connected to feed line 140 via phase shifter 168. The other end of feed line 166 is connected to feed line 150 via phase shifter 170. Phase shifters 162, 164, 168 and 170 are able to move vertically in parallel to the longer length of the antenna body. Referring to FIGS. 1, 2A and 2B, it is seen that the phase shifter 162 is free to move in relation to the fixed center conductor line connecting terminal elements 122 and 124 previously described. Likewise, phase shifters 164, 168 and 170 are all generally free to move in the same manner, relative to their respective antenna elements above and below their location (132 and 134; 142 and 144; 152 and 154). Phase shifters 162, 164, 168 and 170 are connected in unison by mechanical arm 182. Mechanical arm 182 may be connected at any location along its length to a lever 184 to move the phase shifters 162, 164, 168 and 170 to adjust the phase relationship between the terminal elements 120, 122, 124, 126, 128, 130, 132 and 134.

Figure 2C:
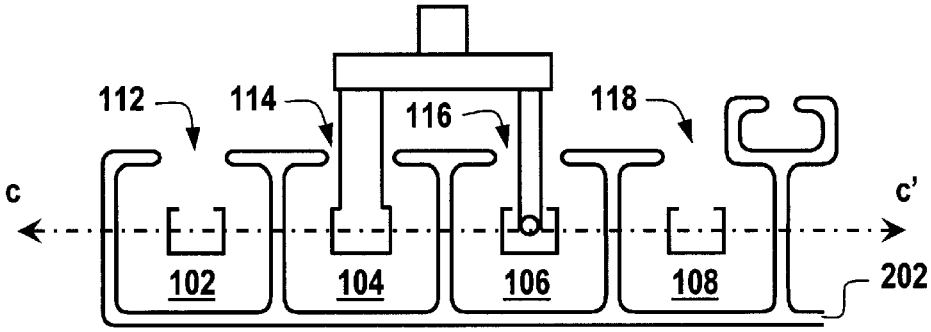

Cavity 104 contains one feed line 172. One end of feed line 172 is connected to feed line 160 via phase shifter 174. The other end of feed line 172 is connected to feed line 166 via phase shifter 176. Referring to FIGS. 1 and 2C, it is seen that the phase shifter 174 is free to move in relation to the feed line 160. Likewise, phase shifter 176 is generally free to move in the same manner in relation to feed line 166. Phase shifters 174 and 176 are connected in unison by mechanical arm 186. Mechanical arm 186 may be connected at any location along its length to a lever 184 to move the phase shifter 174 and 176 to adjust the phase relationship between the feed lines 160 and 166.

Figure 2D:
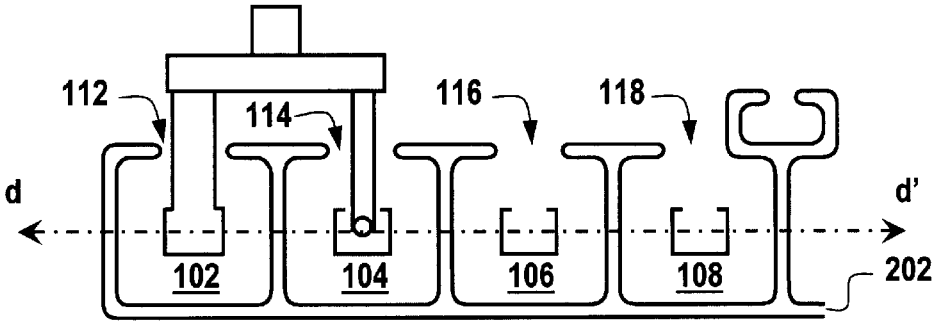

Cavity 102 contains one feed line 178. One end of feed line 178 is connected to feed line 172 via phase shifter 180. Referring to FIGS. 1 and 2D, it is seen that the phase shifter 180 is free to move in relation to the feed line 172. Phase shifter 180 is connected to mechanical arm 188. Mechanical arm 188 may be connected at any location along its length to a lever 184 to move the phase shifter 180 to adjust the phase relationship of feed line 172.

A person of skill in the art will appreciate, based on the present disclosure, that adjacent mechanical arms 186 and 188 may also be connected to the same or different levers to adjust the phase shift between feed lines. The feed lines 120, 130, 140, 150, 160, 166, 172 and 178 distribute the RF energy from the coupling points to the ends of the elements or the next phase shifter. The lever arm 22 will cause the shift of the mechanical arms to control the phase shift and is under the control of a motor (not depicted). The lever may be moved by a computer controlled motor or manually adjusted.

Transmission line arms 190 and 192 connect at transmission line elbows 194, 196 and 198 to translate the moving center conductor 178 to stationary input 198. The transmission line elbows 194, 196 and 198 allow rotation to maintain electrical conductance during the movement of center conductor 178. Transmission line elbow 198 provides a fixed contact for an RF input/output.

In continuation of the RF path within the phase shifter 174 is located between the ends of floating center conductor ends which are connected to phase shifters 162 and 164. Also phase shifter 176 is located between the ends of floating center conductor which are connected to phase shifters 168 and 170. Phase shifters 174 and 176 can be mechanically joined in unison by mechanical arm 186. Vertical movement is allowed parallel to the antenna body. See FIG. 2C. Continuing on in the RF path within the antenna phase shifter 180 is located between the ends of floating center conductor ends which are connected to phase shifters 174 and 176. Phase shifter 180 can be attached to mechanical arm 188. Phase shift mechanism 180 is free to move parallel to the antenna body. See FIG. 2D. Transmission line elbows 194, 196 and 198 allow the RF connection between floating center conductor and the stationary input terminal of the antenna. See FIG. 2D.

The phase shift mechanism of the present invention may be used in antennas with many different types of radiating elements and may be used to tilt the radiation patterns of either unidirectional or omni-directional antennas. Although one embodiment uses one or more phase shift mechanisms, the present invention is not limited to using any number of phase shift mechanisms, and is not limited to use with an antenna having eight elements. In addition, this arrangement for continuously varying the phase shift of an antenna element may be used in an antenna system using a feed system that is series, binary, or any combination of series and binary feed systems. Although in the present embodiment of the present invention the phase shift mechanisms may provide a linear relationship between radiating elements in the antenna array, the phase shifting mechanism may be varied to produce other kinds of relationships.

Figure 3:
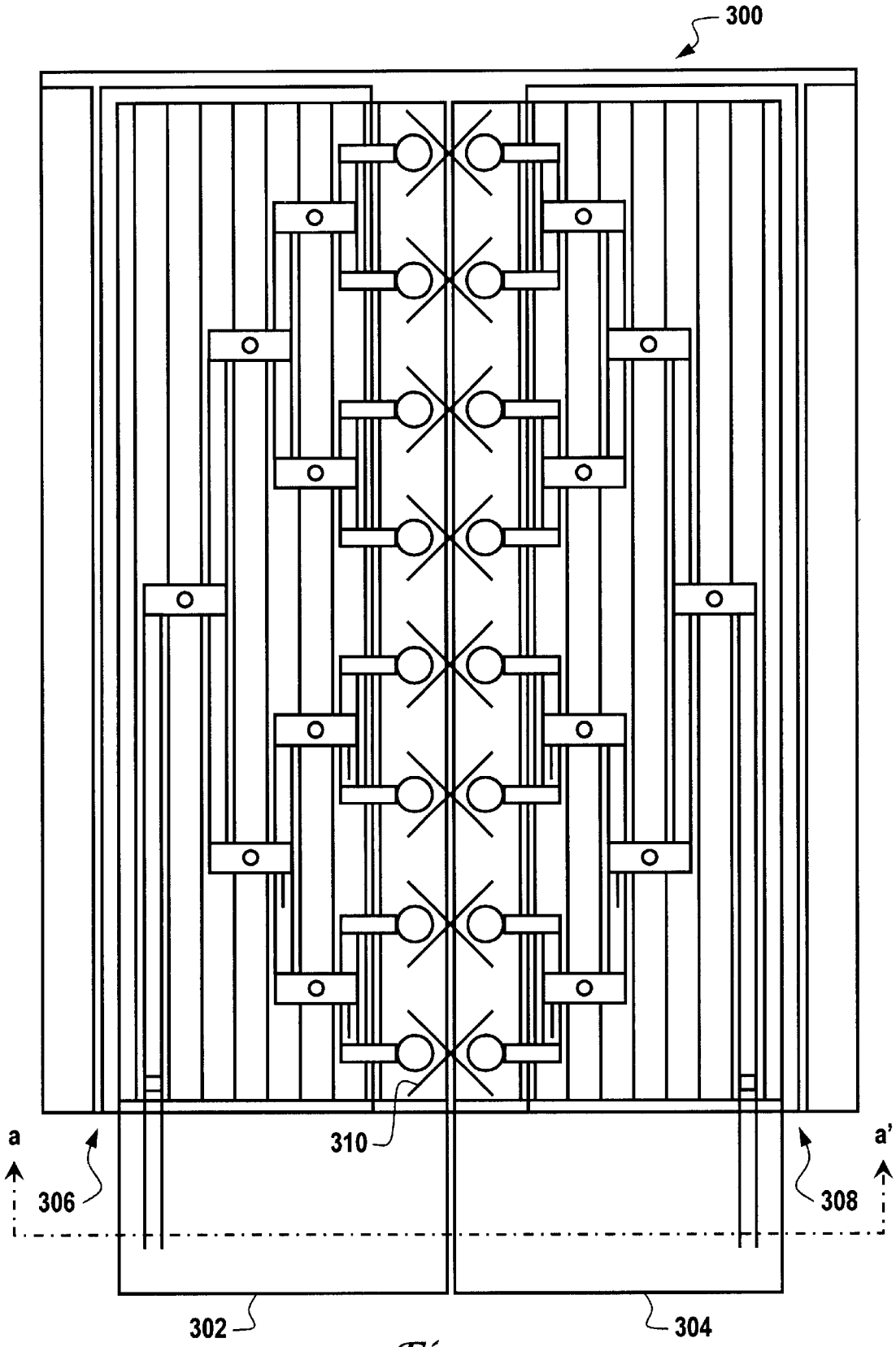
FIG. 3 depicts an eight element antenna array having an adjustable azimuth and phase shift mechanism in accordance with the present invention.

Referring now to FIG. 3, an eight element antenna array 300 having an adjustable azimuth and phase shift mechanism is depicted in accordance with the present invention. The antenna 300 includes a left phase shift mechanism 302 and a corresponding right phase shift mechanism 304. Phase shift mechanisms 302 and 304 were previously described in reference to phase shift mechanism 100 in FIG. 1. The antenna also includes an adjustable azimuth mechanism that includes a left floating reflector 306 and a right floating reflector 308. The radiating elements 310 are connected to respective element terminals 120, 122, 124, 126, 128, 130, 132 and 134 (FIG. 1) of the left and right phase shift mechanisms 302 and 304.

Figure 4:
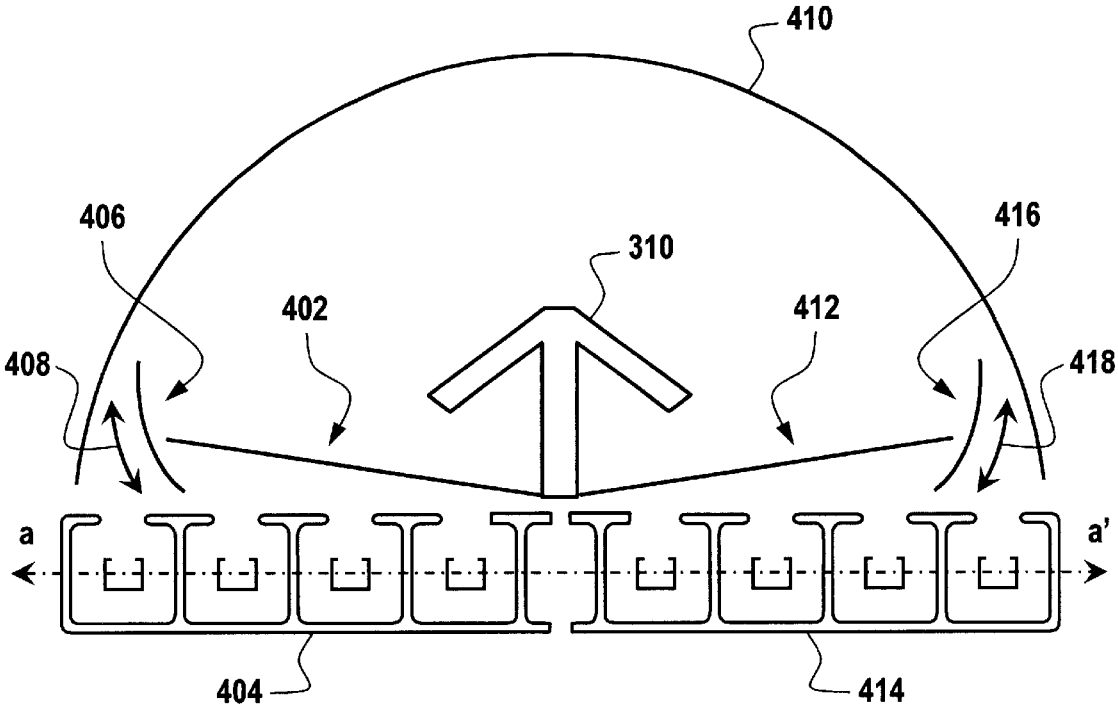
FIG. 4 is a cross-sectional view along the lines as show in FIG. 3 of the various positioned electrically floating reflectors.

Now referring to FIG. 4, a cross-sectional view along the lines a–a' of FIG. 3 is shown. A left stationary reflector plate 402, is located on the left side of the antenna array above the left side of the body of the antenna 404. A left floating reflector 406 is located at the left most position above the left side of the body of the antenna 404. The left floating reflector 406 is free to move in relation to the left stationary reflector plate 402 in an arc 408 between the left stationary reflector plate 402 and the radome 410. The rotation axis of left floating reflector 406 is parallel to the axis of the antenna and positioned to allow the desired movement of the left floating reflector 406.

Similarly a right stationary reflector plate 412 is located on the right side of the antenna above the right side of the body of the antenna 414. A right floating reflector 416 is located at the right most position above the right side of the body of the antenna 414. The right floating reflector 416 is free to move in relation to the right stationary reflector plate 412 in an arc 418 between the right stationary reflector plate 412 and the radome 410. The rotation axis of right floating reflector 416 is parallel to the axis of the antenna and positioned to allow the desired movement of the right floating reflector 416.

As will be recognized by those skilled in the art, the floating reflectors 406 and 416 can be controlled by various mechanical and electrical means, such as a motor that activates a level connected to the floating reflector 406 or 416 via a dielectric hinge. In addition the floating reflectors 406 and 416 can be controlled automatically or manually either locally or remotely. In addition, the floating reflectors 406 and 416 may be used in antennas with many different types of radiating elements and may be used to adjust the radiation patterns of either uni-directional or omni-directional antennas. Although the invention has been described in relation to an eight element antenna array, the invention is not limited to use with an antenna having eight elements.

It is to be understood that the embodiments described herein are merely illustrative of the many possible specific arrangements that can be devised in application of the principles of the invention. Other arrangements may be devised in accordance with these principles by those of ordinary skill in the art without departing from the scope and spirit of the invention. It is therefore intended that such other arrangements be included within the scope of the following claims and their equivalents.

What is claimed is:

1. An antenna comprising:

an antenna body;

a radome connected to the antenna body;

a reflector plate disposed between the antenna body and the radome; and two or more floating reflectors disposed between the antenna body and the radome to adjust the azimuth of the antenna.

2. The antenna as recited in claim 1, wherein the two or more floating reflectors are independently adjustable.

3. The antenna as recited in claim 1, wherein the two or more floating reflectors are remotely controlled.

4. The antenna as recited in claim 1, wherein the two or more floating reflectors are locally controlled.

5. The antenna as recited in claim 1, wherein the two or more floating reflectors are manually controlled.

6. The antenna as recited in claim 1, wherein the two or more floating reflectors are automatically controlled.

7. The antenna as recited in claim 2, wherein the two or more floating reflectors are concave.

8. The antenna as recited in claim 2, wherein the antenna is a unidirectional antenna.

9. The antenna as recited in claim 2, wherein the antenna is an omni-directional antenna.

10. An antenna comprising:

an antenna body having an antenna axis, a first side and a second side;

a radome connected to the antenna body;

a reflector plate disposed between the antenna body and the radome;

a first floating reflector disposed between the antenna body and the radome and between the reflector plate and the first side of the antenna body;

a second floating reflector disposed between the antenna body and the radome and between the reflector plate and the second side of the antenna body; and each floating reflector having a rotation axis parallel to the antenna axis and free to move in relation to the reflector plate.

11. The antenna as recited in claim 10, wherein the first floating reflector and the second floating reflector are independently adjustable.

12. The antenna as recited in claim 10, further comprising one or more radiating elements disposed between the reflector plate and the radome along the antenna axis.

13. The antenna as recited in claim 12, wherein the reflector plate comprises:

a first reflector plate disposed between the antenna body and the radome and between the one or more radiating elements and the first side of the antenna body; and a second reflector plate disposed between the antenna body and the radome and between the one or more radiating elements and the second side of the antenna body.

14. The antenna as recited in claim 13, wherein the first and second reflector plates are disposed from the one or more radiating elements at an angle.

15. The antenna as recited in claim 10, wherein the first and second floating reflector plates are concave.

16. The antenna as recited in claim 10, further comprising one or more phase shift mechanisms disposed within the antenna body and connected to the one or more radiating elements.

17. The antenna as recited in claim 16, wherein the one or more phase shift mechanisms extend above the antenna body between the antenna body and the reflector plate.

18. The antenna as recited in claim 10, further comprising one or more cavities within the antenna body.

19. The antenna as recited in claim 10, further comprising one or more cavities within the antenna body that are parallel to and on either side of the antenna axis.

20. The antenna as recited in claim 19, wherein the one or more cavities form an outer conductor of an air line coaxial feed system.

* * * * *